US006627592B1

(12) United States Patent
Shamayeli et al.

(10) Patent No.: US 6,627,592 B1
(45) Date of Patent: Sep. 30, 2003

(54) PASTY WASHING AGENT

(75) Inventors: Khalil Shamayeli, Dusseldorf (DE); Thomas Merz, Hilden (DE); Edgar Koppelmann, Hilden (DE); Heinrich-Peter Furitsch, Dusseldorf (DE)

(73) Assignee: Ecolab GmbH & Co. oHG, Dusseldorf (DE)

( * ) Notice: Subject to any disclaimer, the term of this patent is extended or adjusted under 35 U.S.C. 154(b) by 0 days.

(21) Appl. No.: 09/857,741

(22) PCT Filed: Dec. 4, 1999

(86) PCT No.: PCT/EP99/09503

§ 371 (c)(1),
(2), (4) Date: Jun. 8, 2001

(87) PCT Pub. No.: WO00/36071

PCT Pub. Date: Jun. 22, 2000

(30) Foreign Application Priority Data

Dec. 15, 1998 (DE) ..... 198 57 687

(51) Int. Cl.[7] ..... C11D 3/395; C11D 17/00
(52) U.S. Cl. ..... 510/303; 510/309
(58) Field of Search ..... 510/367, 336, 510/403, 404, 309, 310

(56) References Cited

U.S. PATENT DOCUMENTS

| | | | | |
|---|---|---|---|---|
| 4,144,226 A | | 3/1979 | Crutchfield et al. | |
| 4,146,495 A | | 3/1979 | Crutchfield et al. | |
| 4,305,749 A | | 12/1981 | Mildenberger et al. | |
| 4,664,839 A | | 5/1987 | Rieck | |
| 4,820,439 A | | 4/1989 | Rieck | |
| 4,889,644 A | | 12/1989 | Amberg et al. | |
| 4,929,380 A | | 5/1990 | Schulz et al. | |
| 5,221,488 A | | 6/1993 | Amberg et al. | |
| 5,244,593 A | * | 9/1993 | Roselle et al. | 252/99 |
| 5,356,607 A | | 10/1994 | Just | |
| 5,417,951 A | | 5/1995 | Just | |
| 5,494,488 A | | 2/1996 | Arnoldi et al. | |
| 5,501,814 A | | 3/1996 | Engelskirchen et al. | |
| 5,580,941 A | | 12/1996 | Krause et al. | |
| 5,765,724 A | | 6/1998 | Amberg et al. | |
| 5,783,616 A | | 7/1998 | Krause et al. | |
| 5,785,210 A | | 7/1998 | Amberg et al. | |
| 5,830,956 A | | 11/1998 | Stockhausen et al. | |
| 5,847,065 A | | 12/1998 | Krause et al. | |
| 5,854,191 A | | 12/1998 | Krause et al. | |
| 5,854,321 A | | 12/1998 | Krause et al. | |
| 5,880,080 A | | 3/1999 | Amory et al. | |
| 5,929,014 A | * | 7/1999 | Beaujean et al. | 510/336 |
| 5,955,415 A | * | 9/1999 | Gutierrez et al. | 510/312 |
| 6,056,512 A | | 5/2000 | Amberg et al. | |
| 6,165,960 A | | 12/2000 | Amory et al. | |
| 6,248,708 B1 | * | 6/2001 | Merz et al. | 510/404 |

FOREIGN PATENT DOCUMENTS

| | | |
|---|---|---|
| DE | 16 17 141 | 7/1966 |
| DE | 2 200 911 | 1/1972 |
| DE | 2 253 063 | 10/1972 |
| DE | 2 412 837 | 3/1974 |
| DE | 40 30 850 | 4/1992 |
| DE | 42 21 381 | 9/1992 |
| DE | 43 00 772 | 1/1993 |
| DE | 43 03 320 | 5/1993 |
| DE | 44 17 734 | 5/1994 |
| DE | 44 30 418 | 8/1994 |
| DE | 44 28 958 | 2/1996 |
| DE | 196 05 906 | 2/1996 |
| DE | 195 35 082 | 3/1997 |
| EP | 0 022 551 | 7/1980 |
| EP | 0 164 514 | 3/1985 |
| EP | 0 066 944 | 11/1986 |
| EP | 0 253 151 | 6/1987 |
| EP | 0 295 525 | 6/1988 |
| EP | 0 356 707 | 7/1989 |
| EP | 0 373 483 | 6/1990 |
| EP | 0 185 427 | 3/1992 |
| EP | 0 241 984 | 3/1994 |
| EP | 0 721 521 | 9/1994 |
| GB | 1 154 730 | 6/1969 |
| GB | 1 377 092 | 11/1974 |

(List continued on next page.)

OTHER PUBLICATIONS

H. Krussmann et al. "Wash Processes in the Commerical Laundry" *Tenside Surfactants Detergents* vol. 24, 1987.

"Chemothermal Laundry Disinfection" *Hyg Med* vol. 23, No. 4, 1998.

WPI, Derwent Accession no. 98–169805/16, Henkel Ecolab GmbH & Co. OHG: "Storage–stable industrial washing paste–free of anionic surfactants, contains two ethoxylated alcohol(s), alkalizing agent, long–chain alcohol or alkyl ether, and polymeric poly–carboxylate organic builder" & De 1 963 035.

*Primary Examiner*—Yogendra N. Gupta
*Assistant Examiner*—John M Petrunco
(74) *Attorney, Agent, or Firm*—Merchant & Gould P.C.

(57) ABSTRACT

The invention relates to a pasty washing agent for use in commercial laundering which contains a non-ionic surfactant, an organic and/or inorganic builder, a bleaching agent based on peroxygen, and optionally contains other common constituents. The inventive pasty washing agent is characterized in that it contains 30 wt. % to 60 wt. % of non-ionic surfactant, 0.5 wt. % to 5 wt. % of a fatty acid and/or fatty acid alkaline-salt, 5 wt. % to 15 wt. % of citrate and/or citric acid and 15 wt. % to 35 wt. % of an inorganic peroxygen compound. In addition, the pasty washing agent does not contain alkali metasilicate nor a bleach activator. In addition to exhibiting a good cleaning efficiency, the inventive agent has a disinfecting action.

32 Claims, No Drawings

FOREIGN PATENT DOCUMENTS

| | | |
|---|---|---|
| GB | 1 464 427 | 2/1977 |
| WO | WO 91/02792 | 3/1991 |
| WO | WO 91/08171 | 6/1991 |
| WO | WO 92/21760 | 12/1992 |
| WO | WO 93/05134 | 3/1993 |
| WO | WO 93/07276 | 4/1993 |
| WO | WO 93/08251 | 4/1993 |
| WO | WO 93/18140 | 9/1993 |
| WO | WO 94/02618 | 2/1994 |
| WO | WO 94/23053 | 10/1994 |
| WO | WO 94/25579 | 11/1994 |
| WO | WO 94/25583 | 11/1994 |
| WO | WO 95/02044 | 1/1995 |
| WO | WO 95/05477 | 2/1995 |
| WO | WO 95/07350 | 3/1995 |
| WO | WO 95/09229 | 4/1995 |
| WO | WO 95/10592 | 4/1995 |
| WO | WO 95/10615 | 4/1995 |
| WO | WO 95/20039 | 7/1995 |
| WO | WO 95/20663 | 8/1995 |
| WO | WO 95/23211 | 8/1995 |
| WO | WO 95/27049 | 10/1995 |
| WO | WO 95/29282 | 11/1995 |
| WO | WO 95/30010 | 11/1995 |
| WO | WO 95/30011 | 11/1995 |
| WO | WO 95/30743 | 11/1995 |
| WO | WO 95/34627 | 12/1995 |
| WO | WO 98/10049 | 3/1998 |
| WO | WO 93/24623 | 12/1999 |

OTHER PUBLICATIONS

H. Krussman et al. "Waschverfahren in der Gewerblichen Wascherei", Tenside Surfactants Detergents, vol. 24, pp. 241–249 (1987).

Chemothermische Waschedesinfektion–Disenfektionsmittelkomission der Deutschen Gellschaft fur Hygiene und Mikrobiologie, Hyg. Med, vol. 23, pp. 127–129 (1998).

* cited by examiner

PASTY WASHING AGENT

This invention relates to paste-form detergents for use in institutional laundries, to a process for their production and to a disinfecting washing process for institutional laundries.

Detergents used in the home are adapted to domestic requirements. Thus, they are normally powders or are sufficiently liquid to lend themselves to problem-free pouring and dosing. Since liquid detergents are also expected to be stable in storage over relatively broad temperature ranges, organic solvents and/or hydrotropes are often added to them although they do not themselves make any contribution to the washing/cleaning result and, for this reason, are not wanted. One way of avoiding possible dosing problems with insufficiently liquid detergents is proposed in European patent application EP 253 151 A2. This document describes liquid and, in some cases, highly viscous detergents based on nonionic and anionic surfactants which contain polyethylene glycol as hydrotrope and which do not have to be dosed in liquid form by the user, but instead are packed in portions in bags of water-soluble material, for example polyvinyl alcohol.

The paste-form detergent described in European patent EP 295 525 B1 consists of a liquid phase of nonionic surfactant which is liquid at temperatures below 10° C. and —dispersed therein—a solid phase with a certain particle size consisting of washing alkalis, sequestering agents and optionally anionic surfactants. The surfactants or surfactant mixtures used must have a pour point (solidification point) below 5° C. to avoid solidification of the paste at low transportation and storage temperatures. This detergent paste is intended for institutional laundries and has such good flow properties that it can be pumped through a suction line by a conventional delivery pump. However, it has been found that pastes of the type in question are not always able satisfactorily to guarantee the homogeneity of their ingredients during the production process and often tend to separate, even in storage. This separation involves not only the separation of solid from liquid ingredients, but also phase separation of the liquid ingredients.

Another paste-form detergent which contains as nonionic surfactant from 40 to 70% by weight of ethoxylated $C_{10-20}$ fatty alcohol—liquid at room temperature—with an average degree of ethoxylation of 1 to 8, 20 to 50% by weight of ethoxylated and propoxylated $C_{10-20}$ fatty alcohols—liquid at room temperature—with an average degree of ethoxylation of 2 to 8 and an average degree of propoxylation of 1 to 6 and 1 to 10% by weight of soap is described in International patent application WO 95/09229. This paste-form detergent is so pseudoplastic that it does not flow under the effect of gravity at room temperature, but assumes a distinctly lower viscosity on shearing and then flows under the effect of gravity. This paste-form detergent is preferably dosed by shearing to reduce its viscosity and then dosing the flowable product using feed pumps.

International patent application WO 98/10049 describes a paste-form detergent for use in institutional laundries containing nonionic surfactant, organic and/or inorganic builder, alkalizing agent and optionally bleaching agent, enzyme, redeposition-inhibiting polymer and/or other typical ingredients, characterized in that it contains 5% by weight to 30% by weight of an ethoxylated alcohol corresponding to the general formula $R^1—(OC_2H_4)_m—OH$ (I), in which $R^1$ is an alkyl or alkenyl group containing 9 to 15 carbon atoms and the average degree of ethoxylation m can assume values of 1 to 8, 1% by weight to 20% by weight of an ethoxylated alcohol corresponding to the general formula $R^2—(OC_2H_4)_nOH$ (II), in which $R^2$ is an alkyl or alkenyl group containing 12 to 22 carbon atoms and the average degree of ethoxylation n can assume values of 3 to 14, with the proviso that n is greater than m by at least 1.0, 20% by weight to 80% by weight of alkalizing agent, more particularly alkali metasilicate, 1% by weight to 20% by weight of medium-chain to long-chain alcohol or alkyl ether corresponding to the general formula $R^3—O—R^4$ (III), in which $R^3$ is an alkyl or alkenyl group containing 6 to 22 carbon atoms and, more particularly, 8 to 22 carbon atoms and $R^4$ is hydrogen or an alkyl group containing 1 to 6 carbon atoms, and up to 15% by weight of organic builder of the polymeric polycarboxylate type. Polymeric polycarboxylates in this context are understood to be polymerization products of unsaturated mono- and/or dicarboxylic acids which, apart from carboxyl groups, have no other functionalities.

Institutional washing processes differ from household washing inter alia in the fact that, although different types of fabrics and variously soiled fabrics also accumulate, the material simultaneously arriving for washing contains largely the same bulk laundry which allows a washing technique specially adapted to the particular cleaning problem. However, there is a greater demand for high-performance cleaning processes in institutional laundries than in domestic washing because heavily soiled washing and infected hospital laundry can accumulate. To keep detergent consumption as low as possible, institutional laundries almost exclusively use water freed from hardness ions for washing. A detailed overview can be found in the article by H. Krüßmann and H. G. Hloch entitled "Waschverfahren in der gewerblichen Wäscherei", Tenside Surfactants Detergents 24 (1987), 341–349 and the literature cited therein.

The detergents known from the documents cited above have high cleaning performance and are particularly suitable for the institutional washing of soiled laundry. However, in cases where laundry contaminated with microorganisms, possibly even pathogenic microorganisms, accumulates, they are unable to meet the need for simultaneous disinfection so that disinfecting preparations have to be used with them.

Accordingly, there was a need for a detergent of simple composition which would combine high cleaning performance with a disinfecting effect when used in the wash cycle of conventional institutional washing machines.

The present invention, which is intended to satisfy that need, relates to a paste-form detergent for use in institutional laundries containing nonionic surfactant, organic and/or inorganic builder, peroxygen-based bleaching agent and optionally other typical ingredients, characterized in that it contains 30% by weight to 60% by weight of nonionic surfactant, 0.5% by weight to 5% by weight and more particularly 0.5% by weight to 3% by weight of fatty acid and/or fatty acid alkali metal salt, 5% by weight to 15% by weight of citrate and/or citric acid and 15% by weight to 35% by weight of inorganic peroxygen compound and is free from alkali metasilicate and bleach activator. It must be regarded as surprising that, despite the absence of bleach activators, i.e. precursor compounds forming percarboxylic acids under perhydrolysis conditions, such as esters and amides, a detergent with a disinfecting effect is obtained.

The present invention also relates to a process for the washing and disinfection of laundry in institutional laundries using a corresponding paste-form detergent. The detergent is preferably used in the 60° C. wash program, i.e. at a washing temperature of about 60° C. In one preferred embodiment of the process according to the invention, not all the ingredients of the paste-form detergent according to the invention need be used together in one detergent paste, instead one or more of the ingredients, particularly the inorganic peroxygen compound, can be separately used, in which case a paste-form detergent corresponding to a detergent according to the invention except for the missing ingredient(s) is additionally used. In this particular embodiment, it is possible where a multiple-chamber washing installation is used to introduce the ingredient used separately, particularly the inorganic peroxygen compound, into the same chamber as or into a different chamber from the paste-form detergent. The word "separately" as used above is merely intended to describe the property "separately from the paste-form detergent", i.e. the ingredient to be introduced separately may also be used in combination or admixture with other typical detergent ingredients which do not undesirably interact with it.

The liquid phase of the paste-form detergent according to the invention is essentially formed by nonionic surfactants. A detergent according to the invention contains preferably 32% by weight to 55% by weight and more preferably 35% by weight to 50% by weight of nonionic surfactant in the form of one or more ethoxylated and/or propoxylated alcohols, preferably those corresponding to the above formula I or II. Mixtures of these nonionic surfactants are particularly preferred. Alcohols or ethers corresponding to formula III above and optionally additional surfactants corresponding to general formula IV:

$$R^5—(OC_2H_4)_x—(OC_3H_6)_y—OH \quad (IV)$$

in which $R^5$ is an alkyl or alkenyl group containing 9 to 15 carbon atoms and, more particularly, 12 to 15 carbon atoms and the average degree of ethoxylation x can assume a value of 3 to 7 and the average degree of propoxylation y a value of 2 to 8, may also be present in detergents according to the invention. The viscosity of the detergent according to the invention can be adjusted by combining ethoxylated alcohols corresponding to formulae I and II. In the compounds corresponding to formulae I, II and IV, the substituents $R^1$, $R^2$ and $R^5$ may be linear or branched, for example methyl-branched in the 2-position, linear chains containing primary etherified alcohol functions being preferred. The nonionic surfactant corresponding to formula I preferably has a carbon chain length of 8 to 14 carbon atoms and, more particularly, 12 to 14 carbon atoms and an average degree of ethoxylation m of 1 to 8 and, more particular, 1 to 5. The nonionic surfactant corresponding to formula II has a broader carbon chain length distribution towards longer chains with 12 to 22, preferably 12 to 18 and more preferably 16 to 18 carbon atoms and a higher average degree of ethoxylation n of 3 to 14 and, more particularly, 6 to 12. The ethoxylated alcohols corresponding to formula I and the ethoxylated alcohols corresponding to formula II are preferably present in ratios by weight of 2:1 to 1:1.8. The detergent according to the invention may contain other nonionic surfactants typically used in detergents such as, for example, alkyl polyglycosides and/or fatty acid polyhydroxyamides. However, the surfactant component is preferably free from alcohols which have only been propoxylated.

So far as the substituent $R^3$ is concerned, the foregoing definitions of the substituents $R^1$ and $R^2$ largely apply to the alcohols or ethers corresponding to general formula III which contribute towards the particularly favorable low-temperature stability of the detergents according to the invention, which are responsible for the substantial absence of foam and for the reduction in surfactant deposits on the washed laundry and which additionally contribute to the washing performance. Besides hydrogen, $R^4$ is preferably a methyl, ethyl, propyl or butyl group, hydrogen and the methyl group, more especially hydrogen, being particularly preferred. In one preferred embodiment of the invention, the detergents contain up to 15% by weight and preferably from 2% by weight to 10% by weight of compounds corresponding to general formula III.

Fatty acids or alkali metal salts thereof, the so-called soaps, or mixtures of fatty acids and soaps are present in detergents according in quantities of preferably 0.75% by weight to 2.5% by weight and more preferably 1% by weight to 2% by weight. Suitable soaps are, in particular, the alkali metal salts of saturated and/or unsaturated $C_{12-18}$ fatty acids, for example coconut oil fatty acid, palm kernel oil fatty acid or tallow fatty acid; the corresponding acids may also be used as such. It is particularly preferred to use an optionally saponified carboxylic acid mixture of—based on the carboxylic acid mixture as a whole—2% by weight to 8% by weight of $C_{14}$ carboxylic acid, up to 1% by weight of $C_{15}$ carboxylic acid, 18% by weight to 24% by weight of $C_{16}$ carboxylic acid, up to 3% by weight of $C_{17}$ carboxylic acid, 20% by weight to 42% by weight of $C_{18}$ carboxylic acid and 30% by weight to 44% by weight of $C_{20-22}$ carboxylic acid. In fatty acid/soap mixtures, the ratio by weight of fatty acid to fatty acid alkali metal salt is preferably in the range from 1:99 to 50:50 and more preferably in the range from 5:95 to 25:75.

The detergent may optionally contain as further surfactants up to 10% by weight, preferably up to 5% by weight and, more preferably, from 0.5 to 3% by weight of synthetic anionic surfactants selected in particular from alkyl benzenesulfonates, alkyl or alkenyl sulfates and/or ether sulfates. Suitable synthetic anionic surfactants, which are preferably incorporated in the detergent according to the invention in solid, fine-particle and substantially water-free form, include in particular those of the sulfonate or sulfate type which are normally present as alkali metal salts and preferably as sodium salts. However, the above-mentioned surfactants of the sulfonate type in particular may also be used in the form of their free acids. Besides $C_{9-13}$ alkyl benzensulfonates, suitable anionic surfactants of the sulfonate type are linear alkane sulfonates containing 11 to 15 carbon atoms which are obtainable by sulfochlorination or sulfoxidation of alkanes and subsequent saponification or neutralization, salts of sulfofatty acids and esters thereof which are derived from saturated $C_{12-18}$ fatty acids sulfonated in particular in the $\alpha$-position and lower alcohols, such as methanol, ethanol and propanol, and olefin sulfonates which are formed, for example, by sulfonation of terminal $C_{12-18}$ olefins and subsequent alkaline hydrolysis. Suitable surfactants of the sulfate type are, in particular, primary alkyl sulfates with preferably linear alkyl chains containing 10 to 20 carbon atoms which have an alkali metal, ammonium or alkyl- or hydroxyalkyl-substituted ammonium ion as countercation. Derivatives of linear alcohols containing in particular 12 to 18 carbon atoms and branched-chain analogs thereof, so-called oxoalcohols, are particularly suitable. Accordingly, the sulfation products of primary fatty alcohols with linear dodecyl, tetradecyl or octadecyl groups and mixtures thereof are particularly suitable. Particularly preferred alkyl sulfates contain a tallow alkyl group, i.e. mixtures essentially containing hexadecyl and octadecyl groups. The alkyl sulfates may be prepared in known manner by reaction of the corresponding alcohol component with a typical sulfating agent, more particularly sulfur trioxide or chlorosulfonic acid, and subsequent neutralization with alkali metal, ammonium or alkyl- or hydroxyalkyl-substituted ammonium bases. In addition, the sulfated alkoxylation products of such alcohols, so-called ether sulfates, may be present in the detergents. Ether sulfates such as these preferably contain 2 to 30 and, more particularly, 4 to 10 ethylene glycol groups per molecule.

The solid phase of the detergent according to the invention is essentially formed by the alkalizing agents, the inorganic peroxygen compounds and the builders, although other particulate auxiliaries may optionally be present. The solid phase should be homogeneously dispersed in the liquid surfactant phase. The ingredients of the paste-form detergent present as solid phase should be fine-particle materials and should have a mean particle size of 5 $\mu$m to 200 $\mu$m, at most 15% of the particles being larger than 200 $\mu$m in size. It is surprisingly possible to incorporate relatively coarse-particle solids, for example those in which 20 to 50% of the particles are larger than 100 $\mu$m in size, in the paste-form detergents according to the invention without any disadvantages. The mean particle size of the particles forming the solid phase is preferably 10 $\mu$m to 80 $\mu$m and more preferably 10 $\mu$m to 60 $\mu$m, the maximum particle size being below 300 $\mu$m and, more particularly, below 250 $\mu$m. In a preferred embodiment, 90% by weight of the solid powder-form ingredients are smaller than 200 $\mu$m in size and, more particularly, smaller than 150 $\mu$m in size. The mean particle size may be determined by known methods (for example by laser diffraction or Coulter Counter).

The alkalizing agents present as an additional component are often also referred to as washing alkalis. They may largely be assigned to the solid phase. Under the conditions under which the detergents according to the invention are used, they provide for a pH value in the alkaline range which is normally from 9.5 to 11.5 and, more particularly, from 10 to 11 (as measured on a 1% by weight solution of the detergent in ion-exchanged water). The preferred alkalizing agent is alkali metal carbonate which may also be used in admixture with alkali metal hydrogen carbonate. Alkali metasilicates as strong alkalizing agents are not present in the paste-form detergents according to the invention. The detergents generally contain 20% by weight to 80% by weight, preferably 30% by weight to 70% by weight and more preferably 40% by weight to 60% by weight of alkalizing agent. If the presence of phosphate is ecologically acceptable in the use of the detergents according to the invention (for example where the wastewater is subjected to phosphate-eliminating treatment), polymeric alkali metal phosphates, such as sodium tripolyphosphate, may optionally be present in the paste-form detergents according to the invention. Their percentage content is preferably up to 70% by weight and more preferably from 15% by weight to 40% by weight, based on the detergent as a whole, the percentage content of other solids, for example the alkali metal carbonate and/or alumosilicate optionally present, being reduced accordingly. In one preferred embodiment, the detergents according to the invention contain 5% by weight to 15% by weight and more particularly 6% by weight to 10% by weight of alkali metal carbonate and/or alkali metal hydrogen carbonate.

A detergent according to the invention contains citric acid, alkali metal citrate or mixtures thereof as organic builder. Other monomeric polycarboxylic acids and hydroxycarboxylic acids, such as gluconic acid and salts thereof, and also typical co-builders or complexing agents from the class of aminopolycarboxylic acids and polyphosphonic acids, are also suitable. Aminopolycarboxylic acids include nitrilotriacetic acid, ethylene diamine tetraacetic acid, diethylene triamine pentaacetic acid and higher homologs thereof, N,N-bis-(carboxymethyl)-aspartic acid preferably being used. Suitable polyphosphonic acids are 1-hydroxyethane-1,1-diphosphonic acid, aminotri(methylenephosphonic acid), ethylenediamine tetra(methylenephosphonic acid) and higher homologs thereof such as, for example, diethylene tetramine tetra-(methylenephosphonic acid). The acids mentioned above are normally used in the form of their alkali metal salts, particularly their sodium and potassium salts. Other suitable builders include homopolymeric and/or copolymeric carboxylic acids and alkali metal salts thereof, the sodium or potassium salts again being particularly preferred. Builders of this type which have proved to be particularly suitable are polymeric carboxylates and polymeric carboxylic acids with a relative molecular weight of at least 350 in the form of their water-soluble salts, more particularly their sodium and/or potassium salts, such as the oxidized polysaccharides according to International patent application WO 93/08251, polyacrylates, polymethacrylates, polymaleates and, in particular, copolymers of acrylic acid with maleic acid or maleic anhydride, preferably those of 50 to 70% acrylic acid and 50 to 10% maleic acid which are characterized, for example, in European patent EP 022 551. The relative molecular weight of the homopolymers is generally between 1,000 and 100,000 while the relative molecular weight of the copolymers is between 2,000 and 200,000 and preferably between 50,000 and 120,000, based on free acid. A particularly preferred acrylic acid/maleic acid copolymer has a relative molecular weight of 50,000 to 100,000. Suitable but less preferred compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable water-soluble organic builders are terpolymers which contain two unsaturated acids and/or salts thereof as monomers and vinyl alcohol and/or an esterified vinyl alcohol or a carbohydrate as the third monomer. The first acidic monomer or its salt is derived from a monoethylenically unsaturated $C_{3-8}$ carboxylic acid and preferably from a $C_{3-4}$ monocarboxylic acid, more especially (meth)acrylic acid. The second acidic monomer or its salt may be derivative of a $C_{4-8}$ dicarboxylic acid, maleic acid being particularly preferred, and/or a derivative of an allyl sulfonic acid substituted in the 2-position by an alkyl or aryl group. Polymers such as these may be produced in particular by the methods described in German patent DE 42 21 381 and German patent application DE 43 00 772 and generally have a relative molecular weight of 1,000 to 200,000. Other preferred copolymers are those described in German patent applications DE 43 03 320 and DE 44 17 734 which preferably contain acrolein and acrylic acid/acrylic acid salts or vinyl acetate as monomers. The polyacetal carboxylic acids described, for example, in U.S. Pat. No. 4,144,226 and U.S. Pat. No. 4,146,495 which are obtained by polymerization of esters of glycolic acid, introduction of stable terminal groups and saponification to the sodium or potassium salts are also suitable, as are polymeric acids obtained by polymerization of acrolein and Canizzaro disproportionation of the polymer with strong alkalis. They are essentially made of acrylic acid units and vinyl alcohol units or acrolein units. A detergent according to the invention preferably contains 8% by weight to 12.5% by weight of citrate and/or citric acid. Besides citrate and/or citric acid, it contains preferably 2% by weight to 12% by weight and more preferably 5% by weight to 10% by weight of other organic builders in the form of polymeric polycarboxylate.

Besides the phosphate mentioned above, organic builders suitable for use in the detergents according to the invention are crystalline alkali metal silicates and fine-particle alkali metal alumosilicates, more particularly zeolites of the NaA, X and/or P type. Suitable zeolites normally have a calcium binding capacity of 100 to 200 mg CaO/g which may be determined in accordance with DE 24 12 837. Their particle size is normally in the range from 1 $\mu$m to 10 $\mu$m. They are used in dry form. In the present case, the water present in combined form in the zeolites is not problematical. Preferred crystalline silicates, which may be present either on their own or together with the alumosilicates mentioned, are crystalline layer silicates with the formula $NaMSi_xO_{2+x}.yH_2O$, where m is hydrogen or sodium, x is a number of 1.9 to 4 and y is a number of 0 to 20. Preferred values for x are 2, 3 and 4. Crystalline layer silicates such as these are described, for example, in European patent application EP 163 514. Both β- and δ-sodium disilicates $Na_2Si_2O_5.yH_2O$ are particularly preferred, β-sodium disilicate being obtainable, for example, by the process described in International patent application WO 91/08171. Suitable crystalline silicates are commercially available under the names of SKS-6 (manufacturer: Hoechst) and Nabion® 15 (manufacturer: Rhône-Poulenc). The content of inorganic builder in the paste may be up to 35% by weight and is preferably up to 25% by weight and, more preferably, between 10% by weight and 25% by weight.

In addition, the paste-form detergent according to the invention may contain an oxygen-containing oxidizing agent in the form of inorganic peroxygen compounds preferably selected from the group consisting of alkali metal perborate, alkali metal percarbonate and mixtures thereof, sodium perborate tetrahydrate and sodium perborate monohydrate being particularly important alongside sodium percarbonate. Other suitable oxidizing agents are, for example, persulfates and peroxypyrophosphates. Inorganic peroxygen compounds may be present in detergents according to the invention in quantities of preferably 20% by weight to 30% by weight and more preferably 22.5% by weight to 27.5% by weight. The disinfecting strength of the detergents according to the invention at temperatures around 60° C. is developed without the presence of bleach activators so that the detergents according to the invention are normally free from bleach activators which typically improve the oxidizing powder of such oxidizing agents.

In addition, a detergent according to the invention may contain other washing aids which are normally present in quantities of up to about 15% by weight, based on the detergent as a whole. Examples of such washing aids include enzymes, redeposition inhibitors, soil release agents, dye transfer inhibitors, such as homopolymers and/or copolymers of vinyl pyrrolidone and/or vinyl imidazole, optical brighteners, foam regulators and/or dyes and perfumes. Where perfumes which are generally liquid are present, they blend into the liquid phase of detergents according to the invention. By virtue of the small quantities in which they are used, however, they have no significant influence on the flow behavior of the pastes.

The paste-form detergents according to the invention are preferably substantially free from water. By "substantially free from water" is meant a state in which the content of free water, i.e. water which is not present in the form of water of hydration and water of constitution, is up to 5% by weight and preferably below 3% by weight. It is worth remarking that, despite the presence of the peroxyen-containing bleaching agent, higher water contents than in normal paste-form substantially water-free detergents are entirely possible. Organic solvents, which include the low molecular weight and low-boiling alcohols and ether alcohols normally used in liquid concentrates, and hydrotropic compounds may optionally be present in quantities of up to 6% by weight, but are preferably absent.

Enzymes optionally present in the detergents according to the invention include, in particular, enzymes from the class of proteases, lipases, cutinases, amylases, pullulanases, xylanases, hemicellulases, cellulases, peroxidases and oxidases and mixtures thereof, the use of protease, amylase, lipase and/or cellulase being particularly preferred. The percentage content of enzymes is preferably from 0.2% by weight to 1.5% by weight and more preferably from 0.5% by weight to 1% by weight. The enzymes may be adsorbed onto supports and/or encapsulated in membrane materials in the usual way or may be incorporated in the pastes as concentrated water-free liquid formulations. Suitable proteases are known, for example, from International patent applications WO 91/02792, WO 92/21760, WO 93/05134, WO 93/07276, WO 93/18140, WO 93/24623, WO 94/02618, WO 94/23053, WO 94/25579, WO 94/25583, WO 95/02044, WO 95/05477, WO 95/07350, WO 95/10592, WO 95/10615, WO 95/20039, WO 95/20663, WO 95/23211, WO 95/27049, WO 95/30010, WO 95/30011, WO 95/30743 and WO 95/34627. Enzymes stabilized against oxidative damage, for example the proteases and amylases known under the commercial names of Durazym® or Purafect®OxP and Duramyl® or Purafect®OxAm, are preferably used.

Suitable redeposition inhibitors and soil release agents are cellulose ethers, such as carboxymethyl cellulose, methyl cellulose, hydroxyalkyl celluloses and cellulose mixed ethers, such as methyl hydroxyethyl cellulose, methyl hydroxypropyl cellulose and methyl carboxymethyl cellulose. Sodium carboxymethyl cellulose and mixtures thereof with methyl cellulose are preferably used. The soil release agents normally used include copolyesters containing dicarboxylic acid units, alkylene glycol units and polyalkylene units. Soil-release copolyesters of the type mentioned and their use in detergents have been known for some time. For example, DE-OS 16 17 141 describes a washing process using polyethylene terephthalate and/or polyoxyethylene glycol copolymers. DE-OS 22 00 911 relates to detergents containing nonionic surfactant and a copolymer of polyoxyethylene glycol and polyethylene terephthalate. DE-OS 22 53 063 mentions acidic textile finishes containing a copolymer of a dibasic carboxylic acid and an alkylene or cycloalkylene polyglycol and optionally an alkylene or cycloalkylene glycol. European patent EP 0 066 944 relates to textile treatment compositions containing a copolyester of ethylene glycol, polyethylene glycol, aromatic dicarboxylic acid and sulfonated aromatic dicarboxylic acid in certain molar ratios. Methyl- or ethyl-end-capped polyesters containing ethylene and/or propylene terephthalate and polyethylene oxide terephthalate units and detergents containing such a soil-release polymer are known from European patent EP 185 427. European patent EP 241 984 relates to a polyester containing substituted ethylene units and glycerol units in addition to oxyethylene groups and terephthalic acid units. The percentage content of redeposition inhibitors and/or soil-release agents in detergents according to the invention is generally not more than 2% by weight and is preferably between 0.5% by weight and 1.5% by weight.

The dye transfer inhibitors suitable for use in detergents according to the invention include in particular polyvinyl pyrrolidones, polyvinyl imidazoles, polymeric N-oxides, such as poly-(vinylpyridine-N-oxide), and copolymers of vinyl pyrrolidone and vinyl imidazole and mixtures thereof. The percentage content of dye transfer inhibitors in detergents according to the invention is preferably between 0.1% by weight and 2% by weight and more preferably between 0.2% by weight and 1% by weight.

The detergents according to the invention may contain, for example, derivatives of diaminostilbene disulfonic acid and alkali metal salts thereof as optical brighteners, more particularly for textiles of cellulose fibers (for example cotton). Suitable optical brighteners are, for example, salts of 4,4'-bis-(2-anilino-4-morpholino-1,3,5-triazin-6-yl-amino)-stilbene-2,2'-disulfonic acid or compounds of similar structure which contain a diethanolamino group, a methylamino group or a 2-methoxyethylamino group instead of the morpholino group. In addition, brighteners of the optically substituted dibenzofuranyl biphenyl type or the optionally substituted 4,4'-distyryl diphenyl type, for example 4,4'-bis-(4-chloro-3-sulfostyryl)-diphenyl, may also be present. Mixtures of brighteners may also be used. Brighteners of the 1,3-diaryl-2-pyrazolone type, for example 1-(p-sulfamoylphenyl)-3-(p-chlorophenyl)-2-pyrazoline and compounds of similar structure are particularly suitable for polyamide fibers. The percentage content of optical brighteners (or mixtures of optical brighteners) in the detergent according to the invention is generally not more than 1% by weight and is preferably from 0.05% by weight to 0.5% by weight.

Typical foam regulators which may be used in the detergents according to the invention are, for example, mixtures of polysiloxane and silica, the fine-particle silica present therein preferably being silanized. The polysiloxanes may consist both of linear compounds and of crosslinked polysiloxane resins and mixtures thereof. Other foam inhibitors are paraffin hydrocarbons, more particularly microparaffins and paraffin waxes with melting points above 40° C., saturated fatty acids or soaps containing in particular 20 to 22 carbon atoms, for example sodium behenate, and alkali metal salts of phosphoric acid monoesters and/or dialkyl esters in which the alkyl chains contain 12 to 22 carbon atoms. Of these foam inhibitors, sodium monoalkyl phosphate and/or dialkyl phosphate containing $C_{16-18}$ alkyl groups are preferably used. The percentage content of foam regulators is preferably between 0.2% by weight and 2% by weight. In many cases, there is no need at all for the additional use of foam inhibitors.

In order to increase the physical stability and the chemical stability of —in particular—the enzymes optionally present, dehydrating agents, for example in the form of salts which bind water of crystallization, such as water-free sodium acetate, calcium sulfate, calcium chloride, sodium hydroxide, magnesium silicate, or metal oxides, such as CaO, MgO, $P_4O_{10}$ or $Al_2O_3$, may also be used. Dehydrating agents such as these, with which the water content of detergents according to the invention can be reduced to particularly low values, are present in the detergents according to the invention in quantities of preferably 1% by weight to 10% by weight and, more preferably, 2% by weight to 8% by weight.

Paste-form detergents according to the invention are preferably produced by initially introducing the nonionic surfactant(s), optionally adding the alcohol or ether corresponding to formula III and optionally mixing the whole with the mixture of fatty acid alkali metal salt and fatty acid and optionally the foam regulator and the synthetic anionic surfactant to form a homogeneous premix. A premix such as this is largely stable in storage and flowable at temperatures in the range from room temperature to 40° C., even if the ingredients of the premix are not always completely liquid or dissolved at those temperatures. The powder-form constituents, including the citric acid/citrate, of the paste-form detergent are added to the premix thus formed, preferably after heating to temperatures of around 80° C. and are dispersed in the premix, more particularly by stirring. The mixture thus obtained is then preferably subjected to wet grinding which gives the product the required consistency and homogeneity. Other ingredients, more particularly temperature-sensitive or shearing-sensitive ingredients, such as perfume oils and enzymes, are then added and should be uniformly incorporated as carefully as possible in order not to destroy the structure of the paste. Immediately after their production, the detergents according to the invention are flowable and pumpable under the effect of shear forces and can thus be packed in conventional supply containers.

A paste-form detergent according to the invention has a viscosity at 25° C. of 60,000 mPa s to 100,000 mPa s and, more particularly, in the range from 70,000 mPa s to 90,000 mPa s, as measured with a Brookfield rotational viscosimeter (spindle No. 7) at 5 revolutions per minute. These viscosity figures are read off after a measuring time of 3 minutes in order to allow for any thixotropic effect the paste may have. In one particular embodiment of the invention, the paste-form detergent preferably has such a viscosity at room temperature that it does not flow under the effect of gravity. It is then preferably particularly thixotropic and pseudoplastic, i.e. it has a distinctly lower viscosity on shearing and flows under the effect of gravity. In a particularly preferred embodiment, the paste has an apparent viscosity of about 80,000 mPa s to 120,000 mPa s at 25° C. and at a shear rate of 0.0001 $s^{-1}$, as measured with a Bohlin CS rheometer (manufacturer: Bohlin) with a plate/plate measuring system, plate interval 4 mm. On exposure to adequate shear forces, for example a shear rate of $10^{-1}$ for otherwise the same measuring conditions, a detergent according to the invention preferably has a considerably lower viscosity—generally 100 to 1,000 times lower. The reduction in viscosity on shearing is largely reversible, i.e. on removal of the shear forces, the detergent returns to its original physical state without separating. It is important in this connection to bear in mind the fact that the viscosities mentioned are not measured immediately after production of the paste, but instead are the viscosities of stored pastes so to speak in equilibrium because the shear forces acting in the course of the production process lead to a lower paste viscosity which only gradually increases to the critical viscosity. Storage times of one month are generally sufficient for this purpose.

A detergent according to the invention normally has a density of 1.3 kg/l to 1.6 kg/l. The detergent according to the invention can be dosed using conventional paste dispensers, as described for example in International patent application WO 95/29282, German patent application DE 196 05 906, German patent DE 44 30 418 and European patents EP 0 295 525 and EP 0 356 707. A dispenser particularly suitable for dosing pseudoplastic paste-form detergents is known, for example, from International patent application WO 95/09263 and is preferably used for dosing pseudoplastic pastes according to the invention. The detergents according to the invention may optionally be packed in portions in films, particularly water-soluble films. Such films are described, for example, in European patent application EP 253 151. A detergent according to the invention is preferably used in institutional laundries for washing and disinfecting soiled washing. It is used in concentrations of preferably 2 g/l to 5 g/l in the wash liquor.

EXAMPLES

Example 1

The substances listed in the following Table were mixed together and the resulting mixture was ground in a mill (roller mill, continuous throughput). Flowable paste-form detergents M1 to M6 were obtained directly after production. The detergents had a density of ca. 1.4 g/cm$^3$ and a viscosity (as measured at 25° C. with a Brookfield DV-II rotational viscosimeter, spindle No. 5, at 5 r.p.m. after a measuring time of 3 minutes) of ca. 80,000 mPa.s. The viscosity of the pastes did not change significantly after storage for 3 months.

TABLE 1

Composition of paste-form detergents (% by weight)

| | M1 | M2 | M3 | M4 | M5 | M6 |
|---|---|---|---|---|---|---|
| Nonionic surfactant[a)] | 20 | 19 | 19 | — | — | 9 |
| Nonionic surfactant[b)] | 10 | 9 | 7 | 7 | 7 | 9 |
| Nonionic surfactant[c)] | — | — | — | — | 16 | — |
| Nonionic surfactant[d)] | — | — | — | 16 | — | — |
| Nonionic surfactant[e)] | — | — | — | 3 | 3 | — |
| Nonionic surfactant[f)] | 8 | 7 | 9 | 9 | 11 | 19 |
| Alkyl benzenesulfonate | 0.8 | 0.7 | 0.7 | 0.7 | 0.7 | 0.7 |
| Fatty acid/soap[g)] | 1.2 | 1.6 | 1.6 | 1.6 | 2 | 2 |
| Isotridecanol | — | 3 | 3 | 3 | 3 | 3 |
| Na citrate | 10 | 10 | — | 5 | 10 | — |
| Citric acid | — | — | 10 | 5 | — | 10 |
| Na perborate | 25 | 25 | 25 | 25 | 25 | 25 |
| Polymeric polycarboxylate | 4 | 6 | 6 | 6 | 6 | 6 |
| Phosphonate | 0.5 | 1.6 | 1.6 | 1.6 | 1.6 | 1.6 |
| Na hydrogen carbonate | — | 7 | — | — | — | — |
| Foam inhibitor[h)] | 1 | 1 | 1 | 1 | 1 | 1 |
| Opt. brightener | 0.2 | 0.5 | 0.5 | 0.5 | 0.5 | 0.5 |
| Enzymes | 0.6 | 0.8 | 0.8 | 0.8 | 0.8 | 0.8 |
| Na carbonate | | | to 100 | | | |

[a)] $C_{12-14}$ fatty alcohol + 3 EO (Dehydol ® LS 3, a product of Henkel KGaA)
[b)] $C_{12-18}$ fatty alcohol + 7 EO (Dehydol ® LT 7, a product of Henkel KGaA)
[c)] $C_{9-11}$ oxoalcohol + 3 EO (Lutensol ® ON 30, a product of BASF)
[d)] $C_{9-11}$ oxoalcohol + 7 EO (Lutensol ® ON 70, a product of BASF AG)
[e)] oleylcetyl alcohol + 2 EO (Foryl ® 502, a product of Henkel KGaA)
[f)] $C_{12-14}$ fatty alcohol + 4 EO + 5 PO (Dehypon ® LS 54, a product of Henkel KGaA)
[g)] $C_{16/22}$ fatty acid 85% present as Na salt (Edenor ® W 35, a product of Henkel KGaA)
[h)] mono/distearyl phosphate

Example 2

Determination of the Disinfecting Effect of M1

Material and Method 4.2 Chemothermische Wäschedesinfektion (Chemothermal Disinfection of Laundry—Desinfektionsmittelkomission der Deutschen Gesellschaft für Hygiene und Mikrobiologie, Hyg. Med. 1998, 23, 127–129.

Test Germs

| | |
|---|---|
| *S. aureus* | ATCC 6538 |
| *E. faecium* | ATCC 6057 |
| *E. coli* | NCTC 10538 |
| *C. albicans* | ATCC 10231 |

1. Determination of Bacteriostatic and Fungistatic Activity and Suitable Inactivating Substances (According to "Richtlinien (Guidelines)" I/2.1)

Growth inhibitions after incubation for 72 hours at 37° C.

| | Final concentrations of M1 10 g/liter-further dilutions 1:1 | | | | | |
|---|---|---|---|---|---|---|
| No inactivator | | | | | | |
| *S. aureus* | – | – | + | + | + | + |
| *E. faecium* | – | + | + | + | + | + |
| *E. coli* | – | + | + | + | + | + |
| *C. albicans* | – | + | + | + | + | + |
| 3% Tween 80 + 0.3 & lecithin + 0.1% cysteine | | | | | | |
| *S. aureus* | – | + | + | + | + | + |
| *E. faecium* | – | + | + | + | + | + |
| *E. coli* | – | – | – | + | + | + |
| *C. albicans* | – | + | + | + | + | + |
| 3% Tween 80 + 3% saponin + 0.1% histidine + 0.1% cysteine | | | | | | |
| *S. aureus* | – | – | + | + | + | + |
| *E. faecium* | – | + | + | + | + | + |
| *E. coli* | – | + | + | + | + | + |
| *C. albicans* | – | + | + | + | + | + |
| 3% Tween 80 + 0.3% lecithin + 0.1% histidine + 0.5% Na thiosulfate | | | | | | |
| *S. aureus* | + | + | + | + | + | + |
| *E. faecium* | + | + | + | + | + | + |
| *E. coli* | – | + | + | + | + | + |
| *C. albicans* | + | + | + | + | + | + |
| Inactivating combination in the other tests: 3% Tween 80 + 0.3% lecithin + 0.1% histidine + 0.5% Na thiosulfate | | | | | | |

Meaning of symbols:

+= clouding through germ proliferation
–= no clouding through germ proliferation 2. Bactericidal Activity in the Quantitative Suspension Test (Mod. According to the "Richtlinen" I/2.3)

Process temperature: 60° C.

Germ content of the starting suspension:

*E. faecium ATCC 6057: 9.34 log./ml*
(Prelim. culture on brain heart infusion agar. 48 h at 36 ± 1° C.)

| | Reduction factors (log.) after contact time in mins. | | | |
|---|---|---|---|---|
| Concentrations of M1 (g/liter) | 5 | 10 | 15 | 30 |
| Without alubumin challenge (l/2.3.1) | | | | |
| 6 | 5.07 | ≧5.27 | ≧5.26 | ≧5.26 |
| 3 | 3.50 | ≧5.27 | ≧5.26 | ≧5.26 |
| 1.5 | 3.05 | ≧5.27 | ≧5.26 | ≧5.26 |
| 0.75 | 3.02 | ≧5.27 | ≧5.26 | ≧5.26 |
| Control value (log./20° C.) | 6.27 | 6.27 | 6.26 | 6.26 |
| Control value (log./20° C.) | 6.24 | 6.17 | 6.16 | 6.10 |
| With 0.2% albumin challenge (l/2.3.2) | | | | |
| 6 | 4.90 | ≧5.29 | ≧5.24 | ≧5.10 |
| 3 | 4.51 | ≧5.29 | ≧5.24 | ≧5.10 |
| 1.5 | 3.62 | ≧5.29 | ≧5.24 | ≧5.10 |
| 0.15 | 3.09 | ≧5.29 | ≧5.24 | ≧5.10 |
| Control value (log/20° C.) | 6.31 | 6.29 | 6.24 | 6.10 |
| Control value (log./60° C.) | 6.30 | 6.19 | 6.16 | 6.11 |

3. Testing of Chemothermal Laundry Disinfection

Test germ: Enterococus faecium ATCC 6057

Culture on brain heart infusion agar (BHI), Becton-Dickinson 11065) for 48 hours at 36±1° C. Floating off with physiological common salt solution; after centrifuging and pouring off the supernatant, the germs were taken up in concentrated shaking blood (Oxoid) and homogenized.

Contamination of the Germ Carriers

The swatches of standard cotton cloth (1×1 cm, DIN 53919) were dipped into the germ/blood suspension and dried in open Petri dishes for 3 hours at 36±1° C.

Test Procedure

All the tests were carried out in a Miele WS 5080 automatic washer/dryer. 12.5 ml of shaking blood (Oxoid) per kg of laundry were added to the laundry before the water was run in. On completion of the disinfection phase, i.e. before a clear rinse, the 10 germ carrier were removed and were immediately introduced individually into 5 ml of casein peptone/soybean flour peptone solution (CSL) with inactivating substances+glass beads. Germ detection was carried out after homogenization of the enrichment cultures by shaking (10 mins.; 300 $min^{-1}$) using the casting method. To this end, 1 ml was used directly and 1 ml after dilution (0.5 ml in 4.5 ml CSL) in 20 ml of liquid CSA (casein peptone/soybean flour peptone/agar). The individual swatches were additionally introduced into cast plates. These plates and those previously mentioned were incubated for 3 weeks at 36±1° C.

For the detection of test germs capable of proliferation in the liquor, 100 ml of liquor were removed after the disinfection phase and immediately mixed with 100 ml of double-strength CSL+double-strength inactivating substances.

After incubation for 3, 7 and 21 days at 36±1° C., subcultures were prepared on SLANETZ-BARTLEY agar (Oxoid/CM 377) for detecting the test germs (incubation for 48 hours at 44° C.).

Test Series: M1

3.0 g/l liquor—added at beginning of wash

Disinfection temperature: 60° C.

Contact time: 15 mins.

Liquor ratio: 1:4

| | 1st Test Series | 2nd Test Series | 3rd Test Series |
|---|---|---|---|
| Laundry (bed linen) | 4.72 kg | 4.72 kg | 4.72 kg |
| Blood added | 59.0 ml | 59.0 ml | 59.0 ml |
| Quantity of M1 | 57.0 g | 57.0 g | 57.0 g |
| Heating time | 10 mins. 54 s. | 11 mins. 10 s. | 11 mins 7 s. |
| Measured temp.: | | | |
| Beginning | 60.3° C. | 60.0° C. | 60.2° C. |
| End | 62.1° C. | 60.4° C. | 60.1° C. |
| Range | 59.9–64.2° C. | 59.8–64.1° C. | 60.0–64.1° C. |
| Starting blood germ suspension log/CFU/ml | 10.70 | 10.70 | 10.70 |
| per germ carrier | 9.70 | 9.70 | 9.70 |
| log CFU | 9.60 | 9.60 | 9.60 |
| | 9.65 | 9.65 | 9.65 |
| x | 9.65 | 9.65 | 9.65 |

Recoverable CFUs after Exposure

| | 1 ml CSA | Cast plate | RF |
|---|---|---|---|
| Germ carrier 1 | 0 | + | >8.95 |
| Germ carrier 2 | 0 | + | >8.95 |
| Germ carrier 3 | 2 | + | 8.65 |
| Germ carrier 4 | 1 | + | 8.95 |
| Germ carrier 5 | 1 | + | 8.95 |
| Germ carrier 6 | 1 | + | 8.95 |

-continued

| | | | |
|---|---|---|---|
| Germ carrier 7 | 0 | + | >8.95 |
| Germ carrier 8 | 1 | + | 8.95 |
| Germ carrier 9 | 0 | + | >8.95 |
| Germ carrier 10 | 0 | + | >8.95 |

| | 1 ml CSA | Cast plate | RF |
|---|---|---|---|
| Germ carrier 1 | 0 | + | >8.95 |
| Germ carrier 2 | 2 | + | 8.65 |
| Germ carrier 3 | 0 | + | >8.95 |
| Germ carrier 4 | 3 | + | 8.47 |
| Germ carrier 5 | 0 | + | >8.95 |
| Germ carrier 6 | 0 | + | >8.95 |
| Germ carrier 7 | 0 | – | >8.95 |
| Germ carrier 8 | 0 | + | >8.95 |
| Germ carrier 9 | 1 | + | 8.95 |
| Germ carrier 10 | 3 | + | 8.47 |

| | 1 ml CSA | Cast plate | RF |
|---|---|---|---|
| Germ carrier 1 | 0 | + | >8.95 |
| Germ carrier 2 | 0 | + | >8.95 |
| Germ carrier 3 | 0 | + | >8.95 |
| Germ carrier 4 | 0 | + | >8.95 |
| Germ carrier 5 | 0 | + | >8.95 |
| Germ carrier 6 | 0 | + | >8.95 |
| Germ carrier 7 | 0 | + | >8.95 |
| Germ carrier 8 | 1 | + | 8.95 |
| Germ carrier 9 | 0 | + | >8.95 |
| Germ carrier 10 | 0 | + | >8.95 |

+ = growth of test germ (germ carriers in cast plates)
– = no growth of test germ (germ carriers in cast plates)

No detection of the test germ in the enrichments of 100 ml liquor. Six sterile swatches exposed in the 1st test series showed no detection of the test germs in the enrichment culture.

Test Series no detergent

Miele WS 5080 automatic washer/dryer liquor ratio: 1:4

| | 1st Test Series |
|---|---|
| Laundry: | bed linen 4.72 kg |
| Blood added: | 59.0 ml |
| Heating time: | 12 mins. 44 s. |
| Disinfection temperature: | 60° C. |
| Disinfection time: | 15 mins. |
| Measured temp.: | |
| Beginning: | 60.1° C. |
| End: | 61.6° C. |
| Range: | 60.0–64.2° C. |
| Starting blood germ suspension | |
| log CFU/ml: | 10.70 *E. faecium* |
| Per germ carrier | |
| log CFU: | 9.70 |
| | 9.60 |
| | 9.65 |
| x: | 9.65 |

| Recoverable CFUs (log) on | 1 ml CSA | Cast plate | RF |
|---|---|---|---|
| Germ carrier 1 | 398 | + | 6.35 |
| Germ carrier 2 | 578 | + | 6.19 |
| Germ carrier 3 | 714 | + | 6.10 |
| Germ carrier 4 | 178 | + | 6.70 |
| Germ carrier 5 | 156 | + | 6.76 |
| Germ carrier 6 | 44 | + | 7.31 |
| Germ carrier 7 | 311 | + | 6.46 |
| Germ carrier 8 | 262 | + | 6.53 |

-continued

| | | | |
|---|---|---|---|
| Germ carrier 9 | 436 | + | 6.31 |
| Germ carrier 10 | 360 | + | 6.40 |

+= detection of test germ (swatches in cast plates)
−= no detection of test germ (swatches in cast plates)
Detection of test germ in the liquor (enrichment).

4. Evaluation of the Results

The tests were carried out to the standard of "4.2 Chemothermische Wäschedesinfektion" (April 1998) of the Deutsche Gesellschaft für Hygiene und Mikrobiologie. From the present state of knowledge, it may be assumed that, in chemothermal laundry disinfection processes at temperatures of 60° C. and higher, the test germ *Enterococcus faecium* is more resistant than tubercle bacilli and the other test germs previously used *Staphylococcus aureus, Candida albicans* and *Escherichia coli.*

The result of the quantitative suspension tests at 60° C. show that reduction factors of $\geqq 5 \log_{10}$ units were obtained in 10 minutes with the addition of detergent M1 (3.0 g/liter) of interest for the process in the washing machine.

Reduction factors of greater than $8.5 \log_{10}$ units were also in the tests for the suitability of the chemothermal laundry disinfection process under difficult conditions with 12.5 ml of added blood per kg laundry.

Similarly good disinfection results were obtained with detergents M2 to M6 of Example 1.

What is claimed is:

1. A paste-form detergent for use in institutional laundries comprising 30% by weight to 60% by weight of nonionic surfactant, 0.5% by weight to 5% by weight of fatty acid and/or fatty acid alkali metal salt, 5% by weight to 15% by weight of citrate and/or citric acid and 15% by weight to 35% by weight of inorganic peroxygen compound, wherein the detergent is free from alkali metasilicate and bleach activator.

2. A detergent as claimed in claim 1, comprising 32% by weight to 55% by weight of nonionic surfactant comprising at least one of an ethoxylated alcohol, a propoxylated alcohol, and an ethoxylated/propoxylated alcohol.

3. A detergent as claimed in claim 1, comprising 0.75% by weight to 2.5% by weight of the fatty acid and/or fatty acid alkali metal salt.

4. A detergent as claimed in claim 1, comprising a mixture of fatty acid and fatty acid alkali metal salt in a ratio by weight of 1:99 to 50:50.

5. A detergent as claimed in claim 1, comprising 8% by weight to 12.5% by weight of citrate and/or citric acid.

6. A detergent as claimed in claim 1, further comprising 2% by weight to 12% by weight of an organic builder comprising a polymeric polycarboxylate.

7. A detergent as claimed in claim 1, comprising 20% by weight to 30% by weight of inorganic peroxygen compound.

8. A detergent as claimed in claim 1, wherein the inorganic peroxygen compound is selected from the group consisting of alkali metal perborate, alkali metal percarbonate and mixtures thereof.

9. A detergent as claimed in claim 1, comprising up to 5% by weight alkyl benzenesulfonate.

10. A detergent as claimed in claim 1, wherein the composition, when provided in the form of a 1% by weight aqueous solution has a pH value of 9.5 to 11.5.

11. A detergent as claimed in claim 1, wherein the composition has a viscosity at 25° C. in the range from 60,000 mPa.s to 100,000 mPa.s (Brookfield rotational viscosimeter, spindle No. 7, 5 r.p.m.).

12. A detergent as claimed in claim 1, comprising 5% by weight to 15% by weight of alkali metal carbonate and/or alkali metal hydrogen carbonate.

13. A detergent as claimed in claim 1, wherein the paste-form detergent comprises a solid phase comprising fine-particle materials with a mean particle size of 5 $\mu$m to 200 $\mu$m.

14. A detergent as claimed in claim 1, wherein the paste-form detergent comprises a solid phase comprising at most 15% particles having a particle size of more than 200 $\mu$m.

15. A detergent as claimed in claim 1, further comprising 0.2% by weight to 1.5% by weight of enzyme.

16. A detergent as claimed in claim 1, comprising 35% by weight to 50% by weight of nonionic surfactant in the form of one or more fatty alcohols.

17. A detergent as claimed in claim 1, comprising 1% by weight to 2% by weight of the fatty acid and/or fatty acid alkali metal salt.

18. A detergent as claimed in claim 1, comprising a mixture of fatty acid and fatty acid alkali metal salt in a ratio by weight of 5:95 to 25:75.

19. A detergent as claimed in claim 1, further comprising 5% by weight to 10% by weight of an organic builder comprising a polymeric polycarboxylate.

20. A detergent as claimed in claim 1, comprising 22.5% by weight to 27.5% by weight of inorganic peroxygen compound.

21. A detergent as claimed in claim 1, comprising up to 0.5% by weight to 3% by weight of alkyl benzenesulfonate.

22. A detergent as claimed in claim 1, wherein the composition, when provided in the form of a 1% by weight aqueous solution has a pH value of 10 to 11.

23. A detergent as claimed in claim 1, wherein the composition has a viscosity at 25° C. in the range from 70,000 mPa.s to 90,000 mPa.s (Brookfield rotational viscosimeter, spindle No. 7, 5 r.p.m.).

24. A detergent as claimed in claim 1, comprising 6% by weight to 10% by weight of alkali metal carbonate and/or alkali metal hydrogen carbonate.

25. A detergent as claimed in claim 1, wherein the paste-form detergent comprises a solid phase comprising fine-particle materials with a mean particle size of 10 $\mu$m to 80 $\mu$m.

26. A detergent as claimed in claim 1, further comprising 0.5% by weight to 1.0% by weight of enzyme.

27. A detergent as claimed in claim 26, wherein the enzyme comprises at least one of protease amylase, lipase, and cellulase.

28. A process for the production of a paste-form detergent, wherein the paste-form detergent comprises 30% by weight to 60% by weight of nonionic surfactant, 0.5% by weight to 5% by weight of fatty acid and/or fatty acid alkali metal salt, 5% by weight to 15% by weight of citrate and/or citric acid, and 15% by weight to 35% by weight of inorganic peroxygen compound, wherein the detergent is free from alkali metasilicate and bleach activator, the method comprising:

preparing a homogeneous premix by introducing the nonionic surfactant and adding the fatty acid and/or fatty acid alkali metal salt;

preparing a dispersion by adding the citrate and/or citric acid to the premix and dispersing therein;

preparing a mixture by adding the inorganic peroxygen compound to the dispersion; and subjecting the mixture to wet grinding so that the mixture acquires a desired consistency and homogeneity.

29. A process according to claim 28, further comprising heating the premix to a temperature of about 80° C.

30. A process according to claim 28, further comprising cooling the dispersion to a temperature of about 45° C.

31. A method according to claim 28, further comprising incorporating additional ingredients.

32. A process according to claim 30, wherein the additional ingredients comprise heat sensitive ingredients, or sheer sensitive ingredients.

* * * * *